United States Patent [19]

Rogers

[11] Patent Number: 4,518,542

[45] Date of Patent: May 21, 1985

[54] CARBURETOR ATTACHMENT

[76] Inventor: Jerry L. Rogers, R.R. 6, Box 2515, Springfield, Mo. 65803

[21] Appl. No.: 238,639

[22] Filed: Feb. 26, 1981

Related U.S. Application Data

[63] Continuation-in-part of Ser. No. 108,419, Dec. 31, 1979, abandoned.

[51] Int. Cl.[3] ..... F02M 7/02

[52] U.S. Cl. ..... 261/34 R; 261/121 A

[58] Field of Search ..... 261/34 R, 121 A

[56] References Cited

U.S. PATENT DOCUMENTS

| | | | |
|---|---|---|---|
| 2,273,979 | 2/1942 | Mock . | |
| 2,826,400 | 3/1958 | Sterner et al. . | |
| 2,890,030 | 6/1959 | Gordon | 261/23 A |
| 2,985,524 | 5/1961 | Jacobus . | |
| 2,996,290 | 8/1961 | Munden . | |
| 3,332,231 | 7/1967 | Walsh . | |
| 3,485,482 | 12/1969 | Fuchs | 261/121 A |
| 3,664,648 | 5/1972 | Seeley, Jr. . | |
| 3,807,707 | 4/1974 | Johnson | 261/34 R |
| 3,883,621 | 5/1975 | Hammerschmied . | |
| 3,896,194 | 7/1975 | Martin | 261/DIG. 38 |
| 4,100,663 | 7/1978 | Crum | 261/34 R |

FOREIGN PATENT DOCUMENTS

| | | | |
|---|---|---|---|
| 431690 | 11/1911 | France | 261/121 A |
| Ad.17366 | 6/1913 | France | 261/121 A |
| 572910 | 2/1924 | France | 261/121 A |
| Ad.31483 | 12/1926 | France | 261/121 A |
| 649920 | 12/1928 | France | 261/121 A |

*Primary Examiner*—Tim Miles

*Attorney, Agent, or Firm*—D. A. N. Chase; Michael Yakimo, Jr.

[57] ABSTRACT

A carburetor attachment is designed for replacing a main jet(s) found in the float chamber of a carburetor. The attachment comprises an elongated tubular member with a bore running therethrough and presenting an opening at the lower end thereof. Threads at the lower end of the tubular member fasten the attachment to the threaded socket presented by removal of the normal main jet. In place, the upper end of the attachment extends above the normal level of the fuel found in the float chamber and has a port thereat providing communication between the internal bore and the surrounding ambient air. An inclined port adjacent the lower end of the tubular member provides a conduit between the surrounding fuel and internal bore. Upon actuation of the carburetor the resulting suction presented within the bore draws the surrounding ambient air and fuel through the respective ports for admixture therein. The resulting mixture is drawn through the opening for subsequent conveyance, through conventional passage means, to the main body of the carburetor.

1 Claim, 7 Drawing Figures

CARBURETOR ATTACHMENT

CROSS REFERENCES TO RELATED APPLICATIONS

This application is a continuation-in-part of application Ser. No. 108,419, filed Dec. 31, 1979, now abandoned.

BACKGROUND OF THE INVENTION

This invention relates to an improvement in a carburetor for an internal combustion engine, and more particularly, to a carburetor attachment designed to replace the conventional main jet(s) found in carburetors.

It is known that the extent of combustion of fuel in the cylinders of an internal combustion engine and resulting engine performance is dependent upon the quality of the fuel/air mixture drawn therein. Accordingly, various devices have appeared either as attachments to the outside of the carburetor or as modifications incorporated therein to increase the degree of atomization of the mixture delivered by the carburetor to the engine. The external devices have included structures for use of rotating vanes, fans, blades and the like interspersed between the carburetor and the intake manifold so as to further excite and atomize the mixture passing therethrough.

Known devices, internal to the carburetor itself, have included apparatus such as nozzles, aspirators and the like interspersed, all or in part, in the main venturi of the carburetor so as to provide a more fully atomized mixture to the associated internal combustion engine.

The above devices, although assumed to be effective in their functions have resulted in relatively complex and expensive structures and/or modifications which must be made to the conventional carburetor. Such attributes have hindered their acceptance due in part to the cost-effectiveness involved.

The present invention pertains to the use of an elongated tubular attachment designed to replace the main jet found in the float chamber of a carburetor. The attachment having an elongated bore functioning as a mixing chamber therein has a port at the upper end thereof positioned so as to be above the normal level of fuel found in the float chamber. Upon actuation of the carburetor, the resulting suction draws the ambient air surrounding the upper end through this orifice and into the internal bore. Concurrently, fuel is drawn through a lower port positioned adjacent the lower end of the attachment so as to be below the normal fuel level. The introduction of the air into the chamber via the top port concurrent with the entry of the fuel therein causes a preatomization of the fuel/air mixture prior to discharge from the attachment for conveyance to the main body of the carburetor. This mixture being atomized prior to discharge into the main venturi of the carburetor enables a fuel/air mixture of high quality to be ultimately injected into the associated internal combustion engine.

It is therefore a general object of this invention to provide an attachment for a carburetor which is effective in increasing the quality of the fuel/air mixture delivered to the associated internal combustion engine.

Another object of this invention is to provide an attachment, as aforesaid, which is susceptible of use with most conventional carburetors.

A further object of this invention is to provide an attachment, as aforesaid, which is designed to replace the main jet of a carburetor.

Still another object of this invention is to provide an attachment, as aforesaid, which is easily installed in and removed from the float chamber of a carburetor.

Another object of this invention is to provide a carburetor attachment, as aforesaid, equipped with a chamber for mixing fuel and air drawn therein so as to provide a preatomized fuel prior to entry into the main venturi of the carburetor.

A still further object of this invention is to provide a carburetor attachment, as aforesaid, which increases gasoline mileage, engine power and reduces carbon build up in the associated internal combustion engine.

Another object of this invention is to provide a carburetor attachment, as aforesaid, which is economical to manufacture and has no moving parts and is therefore durable and long-lived.

Other objects and advantages of this invention will become apparent from the following description taken in connection with the accompanying drawings, wherein are set forth by way of illustration and example a preferred embodiment of this invention.

DESCRIPTION OF THE PREFERRED EMBODIMENT

Initially it is to be understood that the carburetor attachment 10, as to be subsequently described, is adaptable for use with conventional carburetors. Accordingly, the drawings are relatively diagrammatic as they are intended to show only those parts needed for a proper discussion of the present invention.

Figure 3:
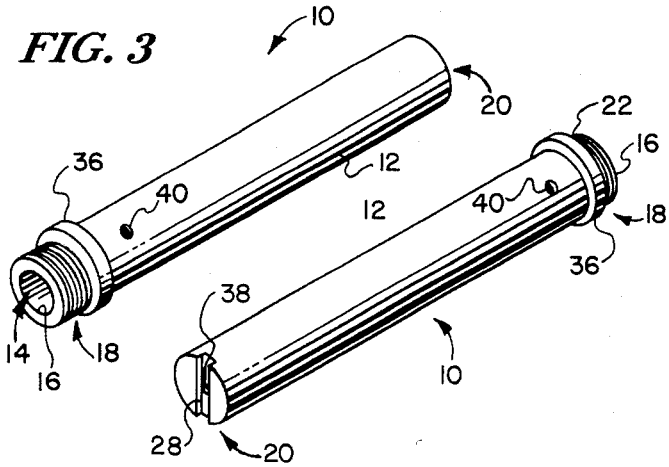
FIG. 3 consists of complementary perspective views showing the upper and lower ends of the carburetor attachment, with the attachment generally horizontally disposed for the purposes of illustration.
Figure 4:
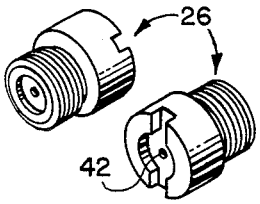
FIG. 4 consists of complementary perspective views showing a replaced main jet of the carburetor.

Referring more particularly to the drawings, the attachment 10 as shown in FIG. 3, comprises a generally elongated tubular member 12 with a central bore 14 running therethrough which presents an opening 16 at the lower end 18 thereof. Member 12 is threaded 22 at the lower end 18 below an annular seating flange 36.

Figure 1:
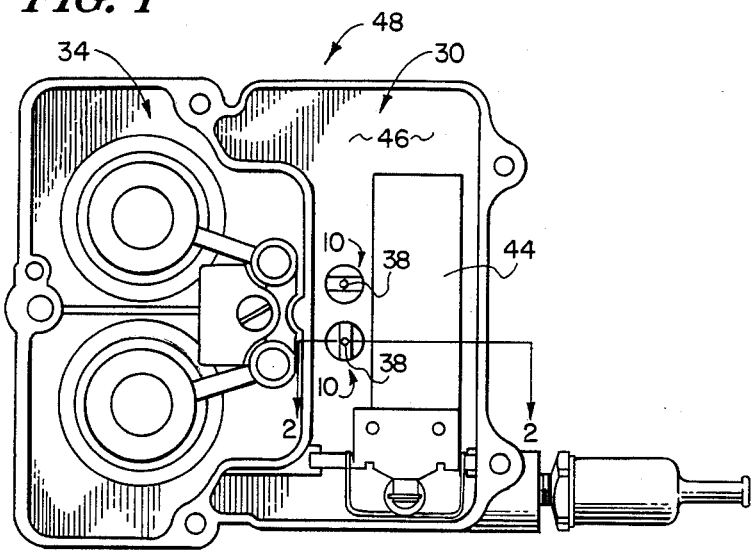
FIG. 1 is a top view of a 2-barrel carburetor showing the main body section and float chamber with the carburetor attachments inserted therein.
Figure 2:
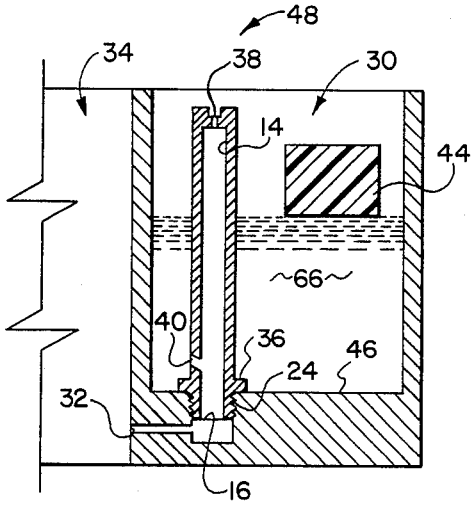
FIG. 2 is a sectional elevation view, taken along line 2—2 in FIG. 1, showing one of the attachments in place of a main jet of the carburetor and diagrammatically showing the passage communicating the float chamber with the main body of the carburetor.

As shown in FIG. 2, the threads 22 are designed to engage a threaded socket 24 which is presented by removal of the main jet 26 normally found in carburetor 48. Slot 28 at the upper end 20 of member 12 enables a screw driver to fit therein for easy insertion of the attachment 10 into socket 24.

As shown in FIG. 2, the bottom surface of seating flange 36 is contiguous to the floor 46 of float chamber 30 to prevent seepage of the surrounding fuel 66 from the float chamber 30 into passage 32. Also, it is preferred that flange 36 be displaced from the lower end 18 so as to place the opening 16 in effective communication with passage 32 found in the normal carburetor. This passage 32 communicates the float chamber 30 with the main body 34 of the carburetor.

At the upper end 20 of attachment 10 is located an air inlet port 38 for communicating the bore 14 with the surrounding ambient air. Adjacent the lower end 18 of attachment 10 is a fuel inlet port 40 for conducting the surrounding gasoline fuel from the float chamber 30 into the central bore 14. As shown, it is preferred that port 40 is downwardly inclined so as to allow the gasoline to flow freely therethrough. Port 40 should be of a diameter corresponding to aperture 42 found in the replaced main jet 26. Air port 38 is preferrably of a smaller size than port 40, the purpose of which is to be subsequently explained.

Prior to the above discussed replacement of jet 26 with attachment 10, it may be necessary to trim the float 44 found in float chamber 30 so as to prevent rubbing of this float against the sides of the attachment 10 when in place. Also, it may be necessary to adjust the float 44 so that the normal fuel level will rise above the opening presented by fuel port 40, but not above the opening presented by air port 38.

Upon fastening the attachment 10 to socket 24, the top cover (not shown) of the carburetor 48 can then be mounted thereto. Operation of the internal combustion engine creates a vacuum at the intake manifold used to actuate the carburetor 48. Such vacuum creates a suction within the bore 14 so that the ambient air surrounding the upper end 20 of the attachment 10 is drawn through the air port 38 into the bore 14. Concurrently fuel is conducted by the suction through port 40 into bore 14. Bore 14 in reality is now a vacuum chamber mixing the fuel and air so as to provide an atomized fuel/air mixture upon discharge from opening 16. It is preferred that port 38 be vertically disposed, as shown, to allow an optimum amount of ambient air to be drawn into bore 14. Also, the elongated cylindrical configuration of chamber 14 has been found to be effective in causing an optimal mix with the injected fuel. Upon discharge the mixture is introduced into passage 32 for subsequent conveyance to the main body 34 of carburetor 48.

Because of this introduction of air and fuel into the bore or mixing chamber 14, it is preferred that the size of air port 38 be smaller than the fuel port 40 so that the drawn air does not override the ability of the fuel to enter the bore 14 through port 40. Otherwise, it has been found that the engine will cut out due to the scarcity of fuel in the atomized mixture and, thus, will cause poor engine performance.

In some cases, especially in late model carburetors using a vacuum to expend fumes from the float chamber 30, it may be necessary to vent the carburetor float chamber 30 through the top cover (not shown) to atmosphere. This vent will provide a sufficient amount and quality of ambient air surrounding the upper end 20 necessary for effective function of the attachment 10. However, it is preferred that the attachment 10 itself remain entirely within the float chamber 30.

The attachment 10 in place does not interfere with the functioning of the carburetor 48 and the proper tuning thereof. Because of the pre-atomization of the fuel, readjustment or tuning of the carburetor is normally required. However, the absence of moving parts and the replacement function of attachment 10 enables one to tune the carburetor 48 with no change in the mechanics of the tuning procedure. It has been found that the attachment 10 by providing such an improved air/fuel mixture contributes to an increase in the performance of the associated engine including improved acceleration and gas mileage and is effective in reducing carbon buildup.

Figure 5:
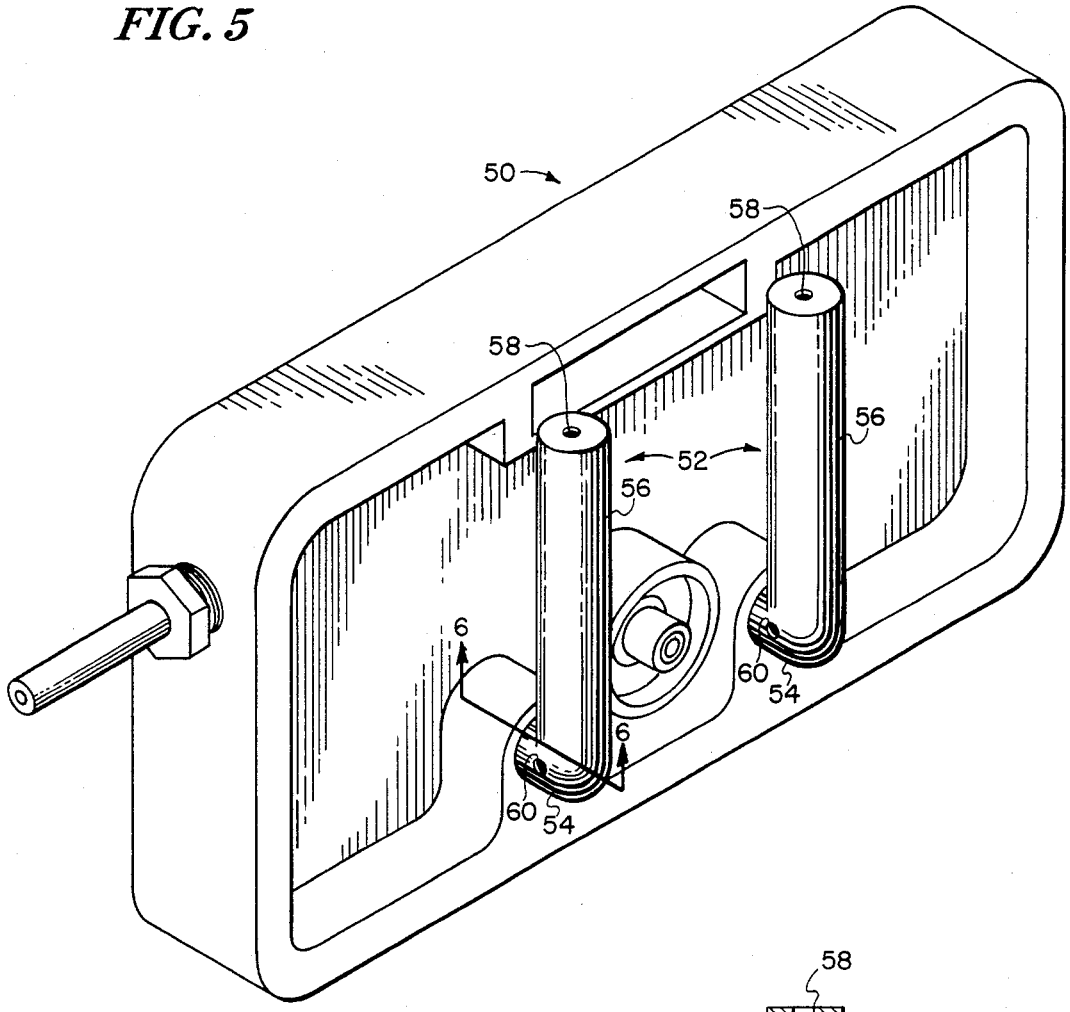
FIG. 5 is a perspective view of a primary metering body for a 4—barrel carburetor, on an enlarged scale, depicting an alternative embodiment of the present invention.
Figure 6:
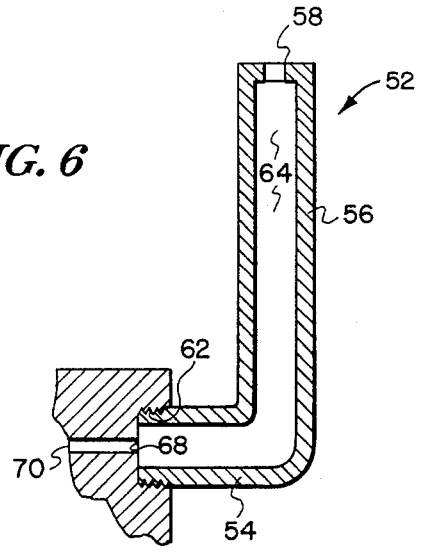
FIG. 6 is a sectional elevation view, on a reduced scale, taken along line 6—6 in FIG. 5.

An alternative embodiment of attachment 10 is shown in FIG. 5 to be used in those carburetors where the normal main running jets are in the side of the carburetor float chamber. A primary metering body 50 for a 4-barrel Holley carburetor is shown with the alternative embodiment 52 in place. The primary main jets have been removed and attachment 52 inserted into the presented sockets 62. As can be seen in FIG. 6, this embodiment consists of the elongated member being configured to present first and second tubular sections or legs 54 and 56 normal one to the other with the internal bore 64 correspondingly running therethrough. Although shown as an integral structure, it is understood that legs 54 and 56 can be separate elements fastened one to the other. Bore 64 presents an opening 68 at the free end of leg 54 so that upon insertion into sockets 62 as presented by the removed main jets, the opening 68 communicates with passage 70. Passage 70, as diagrammatically shown, conveys the fuel from the float chamber to the main body of the carburetor via the metering body 50. Air port 58 is inserted at the top end of leg 56. Fuel inlet port 60 is inserted near the juncture of the horizontal leg 54 with the sockets 62 of primary metering body 50. Upon attachment of this metering body 50 to the main body of the carburetor this alternative embodiment 52 functions in a manner as above described with the same accompanying advantages and results.

Figure 7:
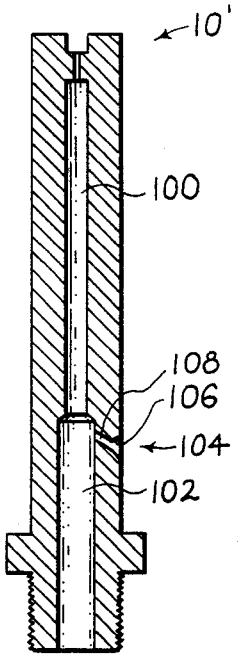
FIG. 7 is a sectional elevation view of another embodiment of the carburetor attachment of FIGS. 2 and 3.

During tests conducted on the above carburetor attachment 10 I have found that certain improvements made in the design of this carburetor attachment 10 can elevate its performance. Accordingly, I have found a redesign of the mixing chamber 14 of the original attachment 10', as shown in FIG. 7, offers improvements thereto. In this embodiment 10' the original mixing chamber 14 now consists of an upper air shaft 100 in communication with a lower air shaft or mixing chamber 102. The air shaft 100 is of a smaller cross-sectional area than the chamber 102 to assure that the volume of drawn air entering the mixing chamber 102 does not override the ability of the fuel to enter the mixing chamber 102 through the port 104.

Fuel inlet port 104 now presents a slight horizontally extending and flared recess 106 in communication with an upwardly extending channel 108. This particular design enables the fuel to lie in the recess 106 before being drawn through the channel 108 and into the chamber 102. This channel 108 has now been upwardly slanted so that the fuel drawn into the mixing chamber 102 is due to the air being drawn through the air shaft 100 and not other factors. This upward extension of the fuel channel 108 provides for a better air/fuel mixture as the fuel and air are arriving in chamber 102 at approximately the same time.

Accordingly, I have found that this interior configuration provides for and maintains a good fuel mixture under low vacuum in the carburetor.

Having then described the invention, what is claimed as new and desired to be secured by Letters Patent is:

1. In an engine carburetor having a main body in communication with said engine, a float chamber, a passage communicating said chamber and said body, an improved jet in said chamber and inserted in said passage for conveying fuel from said float chamber to said passage comprising:

a generally elongated member having upper and lower ends with a bore running therethrough and presenting an opening at said lower end thereof in communication with said passage, said member having a configuration designed to position said upper end above a normal level of fuel found in said float chamber;

said bore consisting of upper and lower communicating shafts with said lowe shaft increasing in cross-sectional area at the point of juncture and having throughout a cross-sectional area greater than said upper shaft;

means for fastening said member to said carburetor with said opening communicating with said passage;

means adjacent said upper end of said member for communicating said upper shaft with the ambient air surrounding said upper end of said member; and means adjacent said lower end of said member for conducting said surrounding fuel from said float chamber into said lower shaft upon actuation of said carburetor, said conducting means comprising a port inserted adjacent said lower end of said member and presenting an upwardly extending channel in communication with said surrounding fuel and said lower shaft, said port further including a recess for receiving a portion of said surrounding fuel therein to prime said channel with said fuel; whereupon actuation of said carburetor said ambient air is drawn through said communicating means and into said upper air shaft, said relatively smaller cross-sectional area of said upper air shaft delimiting the volume of said ambient air drawn therethrough and into said lower shaft in a manner to provide continuity to said conduction of fuel being drawn through said channel and into said lower shaft whereby to maintain a continuous admixture of said fuel and said air within said lower shaft prior to discharge from said opening.

* * * * *

UNITED STATES PATENT AND TRADEMARK OFFICE

CERTIFICATE OF CORRECTION

PATENT NO. : 4,518,542

DATED : May 21, 1985

INVENTOR(S) : JERRY L. ROGERS

It is certified that error appears in the above—identified patent and that said Letters Patent is hereby corrected as shown below:

Claim 1, Column 5, line 24, change "lowe" to --lower--.

Signed and Sealed this

*First* Day of *October 1985*

[SEAL]

*Attest:*

DONALD J. QUIGG

*Attesting Officer*

*Commissioner of Patents and Trademarks—Designate*